US011007660B2

(12) United States Patent
Petratou et al.

(10) Patent No.: US 11,007,660 B2
(45) Date of Patent: May 18, 2021

(54) SHAVER HANDLE AND METHODS OF USE

(71) Applicant: Bic Violex S.A., Anoixi (GR)

(72) Inventors: Eirini Petratou, Athens (GR); Vasiliki Panagiotopoulou, Athens (GR); Athanasia Panou, Athens (GR); Panagiotis Moustakas, Athens (GR); Georgios Pyrris, Athens (GR)

(73) Assignee: BIC VIOLEX S.A., Anoixi (GR)

( * ) Notice: Subject to any disclaimer, the term of this patent is extended or adjusted under 35 U.S.C. 154(b) by 0 days.

(21) Appl. No.: 16/631,993

(22) PCT Filed: Jun. 1, 2018

(86) PCT No.: PCT/EP2018/064430
§ 371 (c)(1),
(2) Date: Jan. 17, 2020

(87) PCT Pub. No.: WO2019/015838
PCT Pub. Date: Jan. 24, 2019

(65) Prior Publication Data

US 2020/0230834 A1 Jul. 23, 2020

Related U.S. Application Data

(60) Provisional application No. 62/534,758, filed on Jul. 20, 2017.

(51) Int. Cl.
*B26B 21/40* (2006.01)

(52) U.S. Cl.
CPC ..... *B26B 21/4056* (2013.01); *B26B 21/40* (2013.01); *B26B 21/405* (2013.01)

(58) Field of Classification Search
CPC .... B26B 21/4056; B26B 21/405; B26B 21/40
See application file for complete search history.

(56) References Cited

U.S. PATENT DOCUMENTS 7,100,283 B1 9/2006 Grdodian et al.
2016/0167241 A1* 6/2016 Goldfarb ..... B26B 21/28 382/108

(Continued)

FOREIGN PATENT DOCUMENTS

WO WO 2009/076301 A2 6/2009
WO WO 2009/076415 A2 6/2009
WO WO 2016/041929 A1 3/2016

OTHER PUBLICATIONS

International Search Report issued in related International Application No. PCT/EP2018/064430, dated Sep. 14, 2018 (3 pages).

*Primary Examiner* — Omar Flores Sanchez
(74) *Attorney, Agent, or Firm* — Bookoff McAndrews, PLLC

(57) ABSTRACT

A shaving system including a shaver handle and one or more sensors. The one or more sensors may be configured to detect a hand of a user on the handle and to generate one or more sensor signals. The system may also include a processor operably coupled to the one or more sensors and having at least one algorithm stored thereon for analyzing the one or more sensor signals to determine a grip of the user's hand on the handle. They system may further include an indicator operably coupled to the processor, and the indicator may be configured to provide at least one of feedback or a recommendation to the user based at least in part on the grip of the user during a shaving session.

17 Claims, 7 Drawing Sheets

(56) References Cited

U.S. PATENT DOCUMENTS

| | | | | |
|---|---|---|---|---|
| 2017/0066147 | A1* | 3/2017 | Ball | B26B 21/526 |
| 2017/0099199 | A1 | 4/2017 | Bauer et al. | |
| 2020/0230834 | A1* | 7/2020 | Petratou | B26B 21/4056 |

* cited by examiner

SHAVER HANDLE AND METHODS OF USE

CROSS-REFERENCE TO RELATED APPLICATIONS

This application is a National Stage Application of International Application No. PCT/EP2018/064430, filed on Jun. 1, 2018, now published as WO2019015838, which claims the benefit of U.S. Provisional Application No. 62/534,758, filed Jul. 20, 2017.

TECHNICAL FIELD

Aspects of the present disclosure relate generally to shaving technology, and, specifically, to embodiments of shavers with sensors for determining the gripping behaviors of a user and methods for providing a customized shaving experience (via, e.g., recommendations for grip alterations or handle configurations) based on the determined gripping behaviors.

DESCRIPTION OF RELATED TECHNOLOGY

Shavers generally include a handle and a razor cartridge releasably attached to one end of the handle, referred to herein as the distal end. The razor cartridge includes at least one blade for shaving hair. The user holds the handle and repeatedly moves the razor across an area of the body to be shaved, e.g., the face, until hair is removed from the surface of the body. Although shaving may be a routine part of many people's hygiene regimen, people may differ on the shaving technique used. Some people may exhibit different shaving behaviors; for example, they may grip their shaver in different ways. Users may also apply different pressures (in terms of where the pressure is applied, but also the magnitude of the pressure) on various parts of the shaver. These differences in shaving behaviors may affect the outcome of their shaving sessions or their shaving experience.

Both the foregoing general description and the following detailed description are exemplary and explanatory only and are not restrictive of the features, as claimed. As used herein, the terms "comprises," "comprising," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges means the value, limit, and/or range +/−10%.

SUMMARY OF THE DISCLOSURE

Embodiments of the present disclosure are directed to a shaving system. The shaving system may include a shaver handle and one or more sensors. The one or more sensors may be configured to detect a hand of a user on the handle and to generate one or more sensor signals. The system may also include a processor operably coupled to the one or more sensors and having at least one algorithm stored thereon for analyzing the one or more sensor signals to determine a grip of the user's hand on the handle. They system may further include an indicator operably coupled to the processor, and the indicator may be configured to provide at least one of feedback or a recommendation to the user based at least in part on the grip of the user during a shaving session.

Various embodiments of the system may include one or more of the following features. The one or more sensors may include one or more piezoelectric sensors, pressure sensors, temperature sensors, light sensors, and conductance sensors. The recommendation may include at least one of a type of handle, a type of shaver, a type of razor cartridge, or a type of blade for the user to use during a subsequent shaving session. At least one of the processor or the indicator may be located on either a phone or a computer. The shaver may include two or more sensors located on the handle. The handle may include a removable sleeve. The one or more sensors may be located on the removable sleeve. The system may also include a razor cartridge, wherein at least one of the one or more sensors is located on the one cartridge. The indicator may include at least one of an auditory, a visual, or a tactile indicator.

Embodiments of the disclosure are also drawn to methods of determining a shaving behavior of a user. The method may include receiving one or more signals indicative of the shaving behavior from one or more sensors located on a shaver. The method may also include analyzing the one or more signals to determine a grip of the user's hand on the handle during a shaving session. The method may further include providing at least one of feedback or a recommendation to the user based on the grip of the user's hand during the shaving session.

Various embodiments of the method may include one or more of the following features. Providing at least one of the feedback or the recommendation may include providing visual feedback on a display. Analyzing the one or more signals may include assessing the one or more signals in combination with information input by the user. The recommendation may include at least one of a type of handle, a type of shaver, a type of razor cartridge, or a type of blade for the user to use during a subsequent shaving session. The feedback may include at least one of shaving efficiency, behaviors during the shaving session, behaviors over a plurality of shaving sessions, behavioral tips for future shaving sessions, and how recommended products could improve the user's shaving experience and/or results. The method may further include generating the one or more signals using the one or more sensors located on the shaver and transmitting the one or more signals to a processor operably coupled to the one or more sensors and having at least one algorithm stored thereon for analyzing the one or more signals.

Embodiments of the disclosure may also be drawn to a method of determining a behavior of a user. The method may include analyzing a plurality of signals generated by a plurality of sensors located on a shaver and determining a grip of the user based on the plurality of signals. The method may also include generating at least one of feedback or a recommendation based on the grip used by the user and providing the feedback or the recommendation to the user.

Various embodiments of the method may include one or more of the following features. The analyzing step may further include analyzing the plurality of signals in combination with information provided by the user. The recommendation may include at least one of a type of handle, a type of shaver, a type of razor cartridge, or a type of blade for the user to use during a subsequent shaving session. The feedback may include at least one of shaving efficiency, behaviors during a shaving session, behaviors over a plurality of shaving sessions, behavioral tips for future shaving sessions, and how recommended products could improve the user's shaving experience and/or results. The method may further include generating the plurality of signals using the plurality of sensors located on a shaver and transmitting the plurality of signals to a processor operably coupled to the plurality of sensors and having at least one algorithm stored thereon for analyzing the plurality of signals.

BRIEF DESCRIPTION OF THE FIGURES

The accompanying drawings, which are incorporated in and constitute a part of this specification, illustrate the disclosed embodiments, and together with the description, serve to explain the principles of the disclosed embodiments. There are many aspects and embodiments described herein. Those of ordinary skill in the art will readily recognize that the features of a particular aspect or embodiment may be used in conjunction with the features of any or all of the other aspects or embodiments described in this disclosure. In the drawings.

DETAILED DESCRIPTION

Reference will now be made in detail to the exemplary embodiments of the present disclosure described below and illustrated in the accompanying drawings. Wherever possible, the same reference numbers will be used throughout the drawings to refer to same or like parts.

Additional objects and advantages of the embodiments will be set forth in part in the description that follows, and in part will be obvious from the description, or may be learned by practice of the embodiments. It is to be understood that both the foregoing general description and the following detailed description are exemplary and explanatory only and are not restrictive of the claims.

Embodiments of the present disclosure may be used to determine a user's shaving behaviors and to promote better shaving choices to create a more efficient and enjoyable shaving experience for users. For example, aspects of the present disclosure include systems and methods to facilitate and promote efficient shaving techniques and/or an improved shaving experience. Embodiments of the present disclosure also include systems and methods to provide feedback and/or recommendations to a user regarding the type of shaving products to use and/or ways to alter the user's shaving habits. For example, aspects of the present disclosure may include one or more sensors embedded within or placed on a surface of one or more of the handle, the razor cartridge, or the blade of a shaver and configured to detect how the user grips and handles the shaver.

Figure 1:
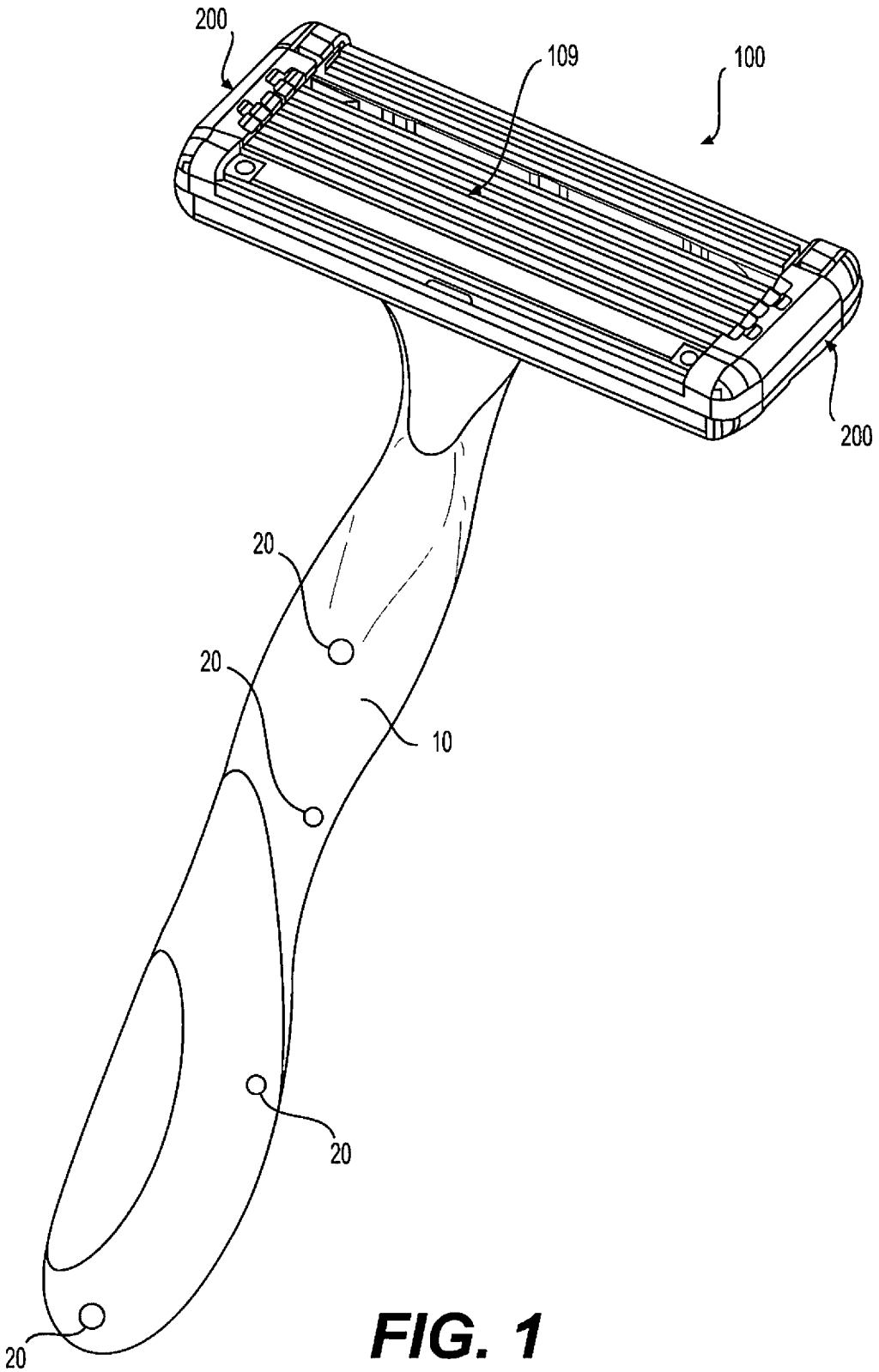
FIG. 1 depicts an exemplary shaving device, according to various embodiments of the present disclosure.

FIG. 1 portrays an exemplary shaver 100. Shaver 100 includes a handle 10 and a razor cartridge 200 having at least one blade 109. Razor cartridge 200 may be releasably secured to handle 10. Shaver 100 may also include one or more sensors 20 configured to collect information about shaver 100 and/or the user during a shaving session. For example, sensors 20 may be configured to detect the gripping behavior of a user and how the user interacts with shaver 10 during a shaving session.

Figure 2A:
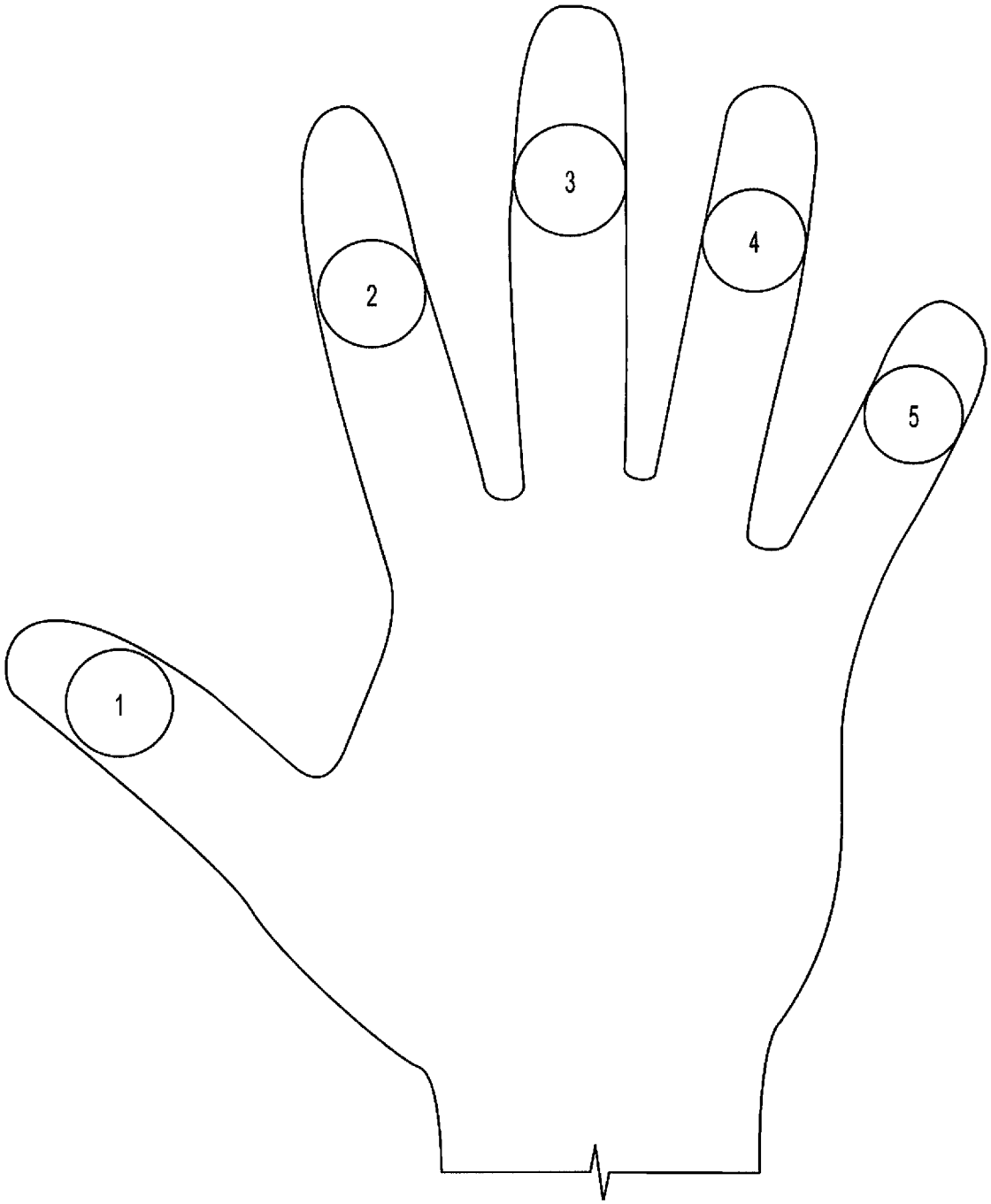
FIG. 2A provides fingers with reference numbers for describing the grips of FIGS. 2B through 2M, according to various embodiments of the present disclosure.

Some common, exemplary gripping behaviors are depicted in FIGS. 2B through 2M. FIG. 2A provides a reference for describing gripping behaviors shown in the figures. Reference number 1 indicates the position of the thumb on shaver 100, reference number 2 indicates the position of the index finger on shaver 100, reference number 3 indicates the position of the middle finger on shaver 100, reference number 4 indicates the position of the ring finger on shaver 100, and reference number 5 indicates the position of the pinky (or little finger) on shaver 100. In FIGS. 2B, 2D, 2F, 2H, 2J, and 2L, handle 10 of shaver 100 is also shown in reflection 10' to depict portions of shaver 10 that may otherwise be obscured from view to portray where a user may grip an under region of handle 10. Additionally, the gripping positions in FIGS. 2C, 2E, 2G, 2I, 2K, and 2M show how a user would hold shaver 100 in his or her right hand; however, it is acknowledged that a user may hold shaver 100 in his or her left hand in a similar manner. For description purposes, when a user holds a shaver 100 with the left hand, the positions may look like mirror images of the positions depicted in FIGS. 2C, 2E, 2G, 2I, 2K, and 2M in the right hand.

Figure 2C:
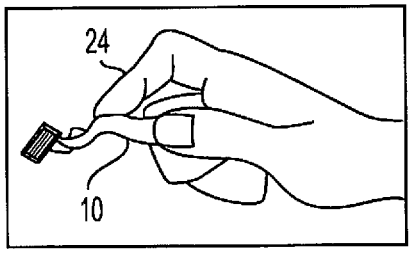
FIGS. 2B-2M depict how exemplary shaving devices may be gripped by a user, with FIGS. 2B, 2D, 2F, 2H, 2J, and 2L depicting perspective views of the exemplary shaving devices are corresponding mirror reflections, according to various embodiments of the present disclosure.
Figure 2B:
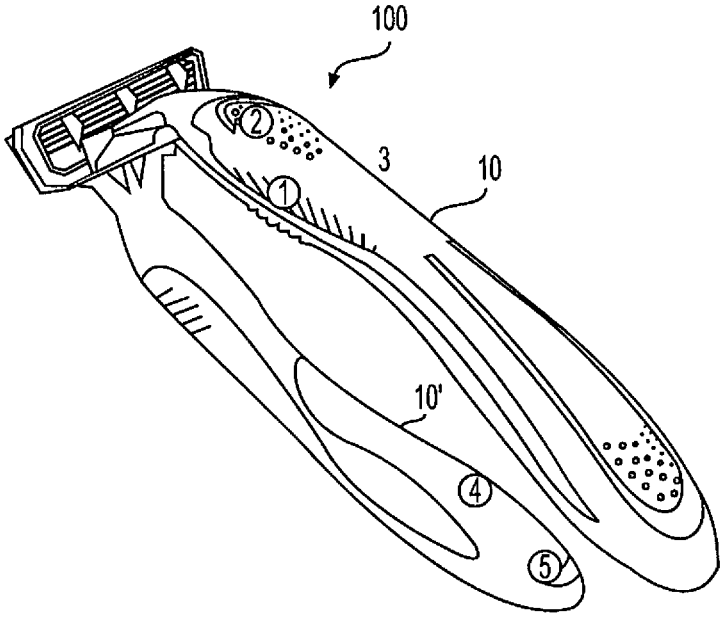

FIGS. 2B and 2C portray an exemplary shaver-gripping position referred to herein as the pen grip. In this grip, as shown in FIG. 2B, a user holds handle 10 with a thumb on a side region of handle 10, with a finger tip of the index finger on an upper, middle region of handle 10, and with a portion of the middle finger touching the side region opposite the thumb. The thumb, index finger, and thumb are located on a distal region of handle 10. A ring finger and a pinky finger may touch proximal, under regions of handle 10. A user's hand 24 holding handle 10 is depicted in the pen grip in FIG. 2C.

Figure 2E:
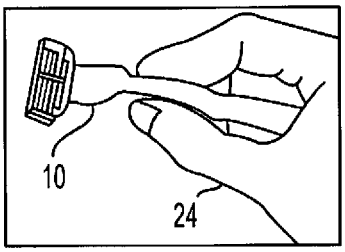
Figure 2D:
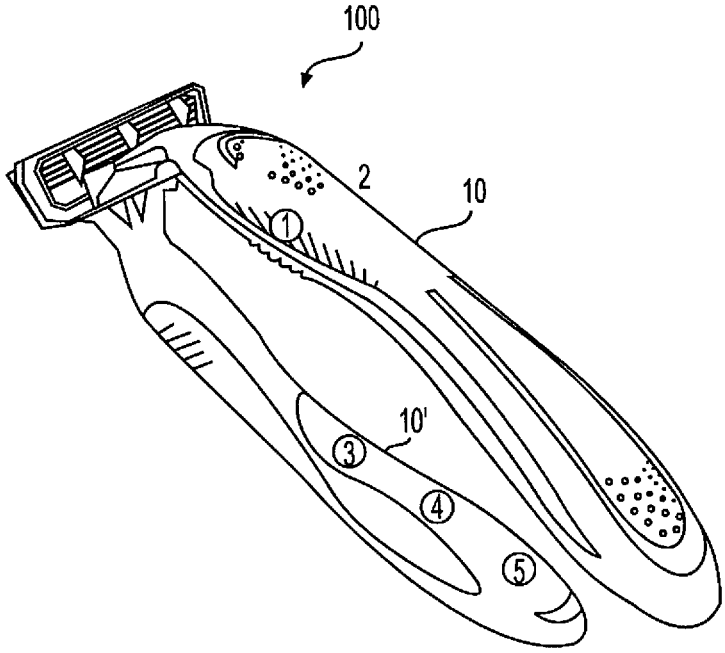

FIGS. 2D and 2E depict an exemplary shaver-gripping position referred to herein as the pincer grip. In the pincer grip, a user places a thumb and an index finger on each side of a distal portion of handle 10. As shown in reflection 10' of FIG. 2D, a middle finger, a ring finger, and a pinky are placed in that order along a more proximal, under region of handle 10. Hand 24 in FIG. 2E is shown holding handle 10 in the pincer grip.

Figure 2G:
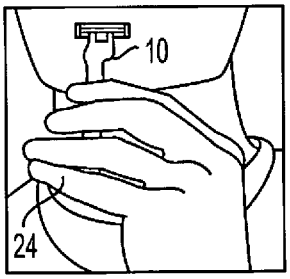
Figure 2F:
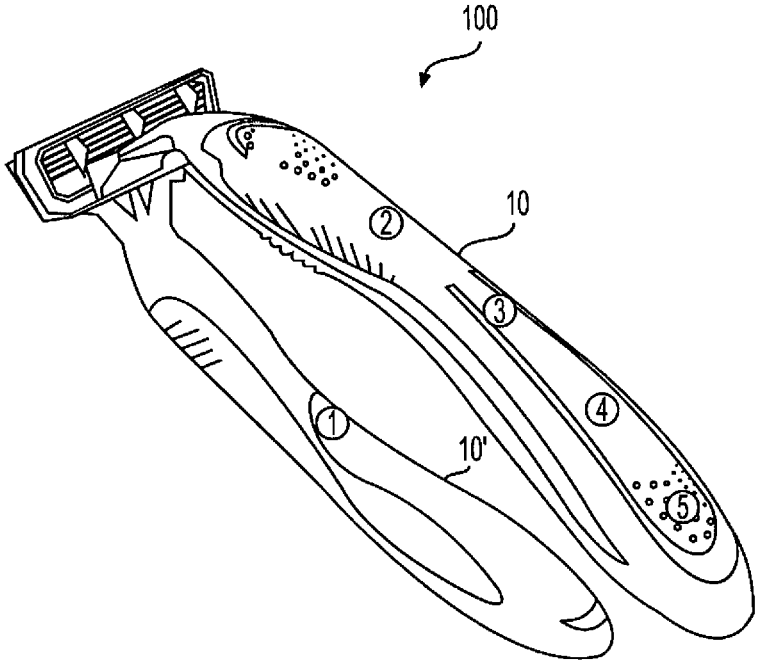

FIGS. 2F and 2G depict how a user would hold handle 10 of shaver 100 in what is referred to as the flute grip. In this grip, a user may place a thumb on an underside of handle 10 and may place an index finger, a middle finger, a ring finger, and a pinky in a row along an upper side of handle 10 from a distal end to a proximal end of handle 10, as shown in FIG. 2F. FIG. 2G depicts hand 24 holding handle 10 in the flute grip.

Figure 2I:
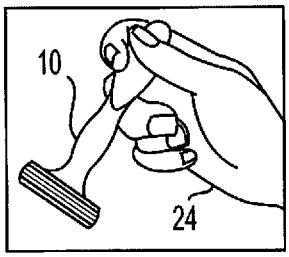
Figure 2H:
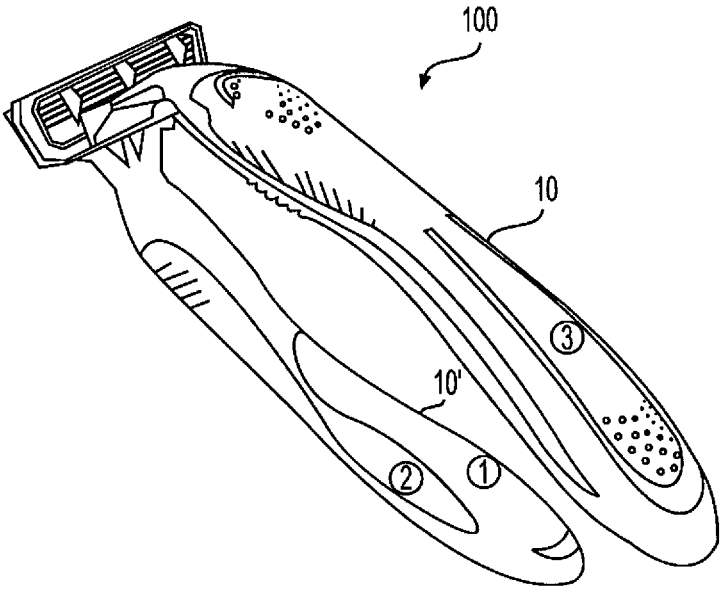

FIGS. 2H and 2I show how a user would hold handle 10 of shaver 100 in a spoon grip. As shown in FIG. 2H, a user may contact a thumb and an index finger on an under region of handle 10, as shown in reflection 10', near the proximal end, and may contact a portion of the middle finger along an upper region of handle 10. As is demonstrated by the portrayal of hand 24 holding handle 10 in FIG. 2I, a user may hold handle 10 so that one or more blades of shaver 100 is facing away from the pinky. This orientation may be utilized by a user, for example, when shaving in a direction moving towards the top of the user's head or otherwise against the grain of hair growth.

Figure 2K:
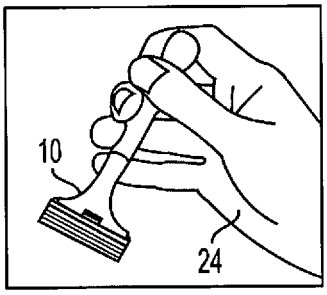
Figure 2J:
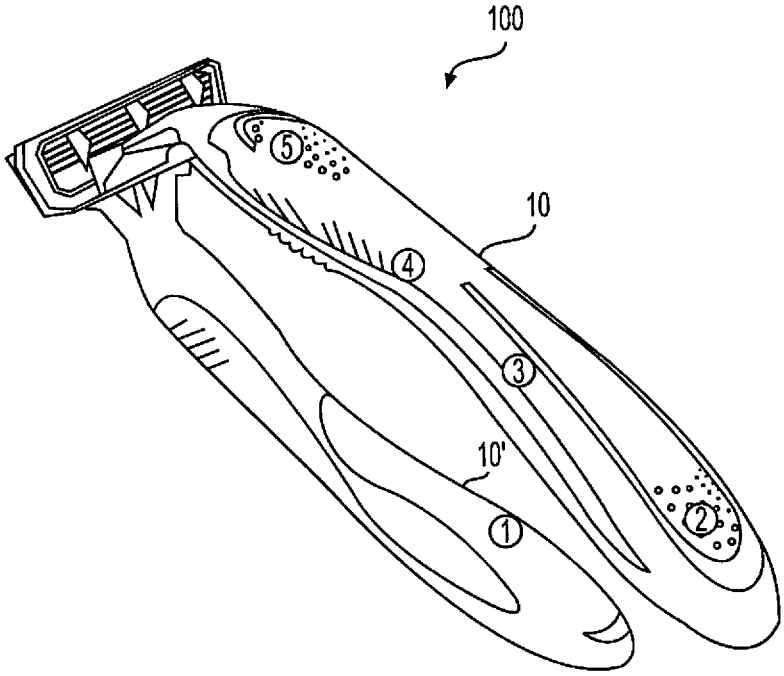

FIGS. 2J and 2K depict how a user would hold handle 10 if using what is referred to as the shovel grip. A user may hold handle 10 so that a pinky, a ring finger, a middle finger, and an index finger are arranged in a row along an upper region of handle 10 from a distal region of handle 10 to a proximal region of handle 10, as shown in FIG. 2J. A user's thumb may be placed on an under, proximal region of handle 10. Like the spoon grip, the shovel grip may be utilized when shaving in a direction towards the top of the user's head or against the grain of hair growth. A user's hand 24 is shown holding handle 10 in the shovel grip in FIG. 2K.

Figure 2M:
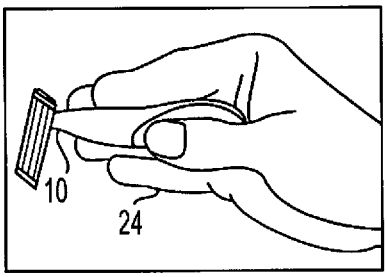
Figure 2L:
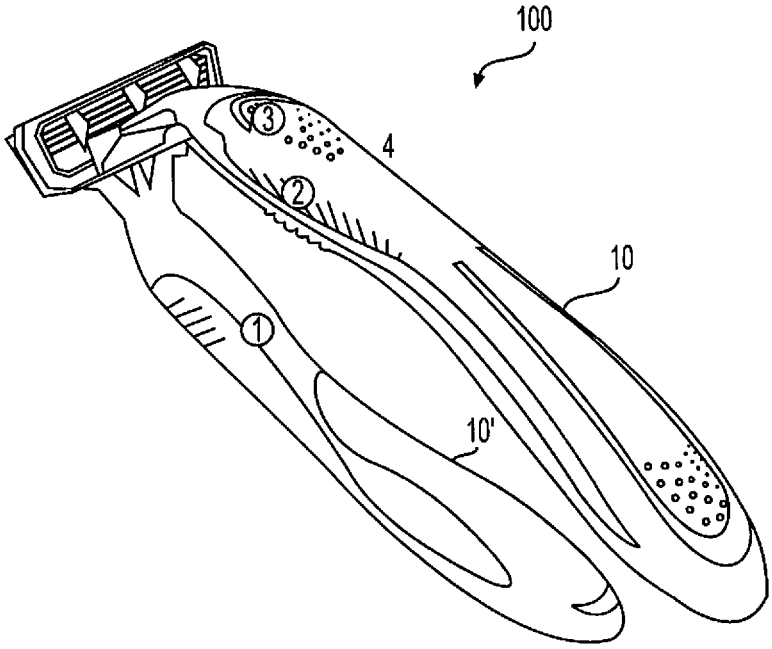

In FIGS. 2L and 2M, a grip referred to as the feather grip is depicted. As shown in FIG. 2L, a user may place a thumb on an under, distal region of handle 10, while placing a middle finger on an upper region of handle 10 closer to the distal end. An index finger and a ring finger may be placed on opposite sides of handle 10 set back slightly from the middle finger. FIG. 2M depicts hand 24 holding handle 10 in the feather grip.

While six different exemplary grip positions are depicted in FIGS. 2B through 2M, other grip positions may be utilized by a user. It is also possible that a user may switch between different grip positions during a single shaving session, for example, when shaving a different region of the body and/or when changing the direction of a shaving stroke.

As alluded to above, shaver 100 may include one or more sensors 20 to detect the one or more grips utilized by a user during a shaving session. Sensors 20 may be used to detect the forces applied to handle 10, e.g., by the user's hand. Exemplary sensors may include one or more piezoelectric sensors, pressure sensors, temperature sensors, light sensors, and/or conductance sensors. For example, piezoelectric sensors, pressure sensors, and/or conductance sensors may be used to detect where a user's hand contacts handle 10, the user's gripping position, and/or the forces the user may apply to the handle during a shaving session. Temperature sensors may be used to detect how close a user's hand is to handle 10 and/or how tightly or loosely a user is grasping handle 10 (e.g., a hand with more tightly clenched muscles may generate more heat than a loose, relaxed hand). Light sensors may be used to determine which portions of handle 10 are covered by a user's hand, or the relative orientation of shaver 100 in space (e.g., relative to a light source as a user maneuvers shaver 100 around his or her body while shaving). In some aspects, sensors 20, regardless of the type of sensor, may cover a substantial entirety of handle 10.

In some embodiments, one or more sensors 20 may also be configured to detect the speed or type of shaving strokes initiated by the user, the skin pH of the user's hand while gripping handle 10, and/or or the slippery effect (i.e., how much the handle of a shaver may slip within the hand of a user when shaving). Suitable sensors for measuring one or more of these characteristics may include, e.g., piezoelectric sensors, pressure sensors, or conductance sensors (as described above), and/or pH sensors, accelerometers, and/or gyroscopes, or any suitable number or combination thereof.

One or more sensors 20 on handle 10 may be the same type of sensor, and/or handle 10 may include different types of sensors 20. By detecting one or more of the parameters described above, individual sensor types or combinations of sensor types may provide information about, e.g., how a user is gripping shaver 100, the amount of pressure the user is applying to shaver 100, the forces (and locations and directions of the forces) the user applies to handle 10, the firmness of the user's grip on handle 10, and/or generally the way a user's hand interacts with shaver 100 throughout a shaving session.

If combinations of different types of sensors are used, more precise information may be available. For example, two or more different sensor types may be used to compare and/or correlate measurements detected by each sensor. A piezoelectric sensor may be used, e.g., with a light sensor and/or a temperature sensor to provide multiple pieces of information to determine how the user is interacting with shaver 100.

Information regarding the grip of a user over multiple shaving sessions may also be detected and stored, and this information may be analyzed to determine usage trends and behaviors. For example, this information may be used to determine how a user typically holds his or her shaver 100, e.g., which of the grips described above or other exemplary grips are used by the user over the course of multiple shaving session. In some aspects, information about the user gathered from one or more shaving sessions may assist in identifying suitable or otherwise appropriate content (e.g., educational or promotional information or videos) or merchandise (e.g., types of shaver handles, blades, shaving cream, or other shaving accessories) for delivery to the user, via, e.g., an associated mobile application loaded on the user's smartphone or other computing device, as will be described further below.

One or more sensors 20 may be operably coupled to a processor to determine the grip(s) used by a user to hold handle 10 and/or other information. For example, the processor may have software and/or one or more algorithms stored thereon that are configured to receive and analyze raw sensor data. Details of exemplary processors are also described further below.

Shaver 100 may include one or more of the above-described sensors and any sensor now known or developed in the future. In addition, the description of the type of information available from each kind of sensor is only for exemplary purposes and is not limited to the description above. One or more sensors may be configured to provide the same or substantially similar information, regardless of the description above.

One or more sensors 20 may be located on any suitable region of shaver 100, including on handle 10, on razor cartridge 200, and/or on one or more blades 109. In some embodiments, sensors 20 may be located along all of handle 10 or along a majority of handle 10. Sensors 20 may be located on an upper side of handle 10 (i.e., the side facing opposite from the sharp side of razor cartridge 200, when attached), along one or more sides of handle 10, and/or on an under side of handle 10 (i.e., the side facing the same direction as the sharp portion of blades 109 of razor cartridge 200, when attached). In some embodiments, sensors 20 may be clustered in regions of handle 10 more likely to be gripped by a user. For example, when observing FIGS. 2B through 2M, there may be a higher density of sensors 20 along the proximal and distal regions of handle 10. By locating sensors 20 in high-grip areas, fewer sensors 20 may need to be included on handle 10 in order to determine the grip utilized by the user.

Additionally, it is contemplated that sensors of various sizes may be incorporated on handle 10. For example, multiple, smaller sensors may be positioned on handle 10, and/or fewer, larger sensors may be included on handle 10. In some embodiments, larger sensors may be used to cover regions of handle 10 that are less likely to be contacted by a user's hand, while a larger number of smaller sensors may be used in regions more likely to be contacted by the user's hand, e.g., to allow for more precise information to be captured in these higher-probability regions.

Sensors 20 may be included on regions of handle 10 where pressure may be applied by a user. Any suitable number of sensors 20 may be included on shaver 100 at any suitable location(s). Further, sensors 20 may be located on a surface of shaver 100 or may be embedded within shaver 100.

In some embodiments, sensors 20 may only be included on handle 10, and not razor cartridge 200 or blades 109, while in other embodiments, sensors 20 may be included on portions of shaver 100 in addition to handle 10. Including multiple sensors 20 at different locations along the handle and/or other components of shaver 100 may provide more information regarding the grip a user tends to utilize when holding shaver 100.

In some embodiments, it is also contemplated that sensors 20 may be included on an element separate from shaver 100 that is configured to attach and detach to shaver 100, rather than being directly incorporated in or on shaver 100. For example, a hard or soft sleeve may be removably or permanently coupled to handle 10. In some embodiments, a sleeve may encase a proximal portion of handle 10 (i.e., a portion opposite razor cartridge 200), or may encase all of handle 10, and may at least partially surround handle 10. A user may hold this sleeve surrounding handle 10 in the same way that he or she would typically hold handle 10. Rather than incorporating sensors 20 into handle 10, sensors 20 may be incorporated into a sleeve configured to removably fit on a variety of different handles 10. The sleeve may be made of any suitable material or combinations of material, including, e.g., rubber or plastic. Sensors 20 in the sleeve may operate the same as those described above incorporated directly into handle 10. In this way, a sensor system may be interchangeably used with a variety of different shavers 100. Further, if recommendations provided to the user based on the grip utilized by the user suggest acquiring a different type of handle 10, then the user may remove the sleeve from the current handle and couple the sleeve to a new, recommended handle 10.

The data detected using one or more sensors 20 (from handle 10 and/or a separate sleeve) may be analyzed to indicate ergonomic information, for example, how a user is gripping handle 10, whether the user changes grips during one or more shaving sessions, how much force or pressure the user applies to handle 10 when gripping, and/or may identify benefits and/or potential issues with the user's grip, the type of handle used, and/or the user's shaving behaviors. The data detected using one or more sensors 20 may also be analyzed to indicate the speed and/or type of shaving strokes applied, and/or the skin pH when gripping handle 10.

In some embodiments, data detected by shaver 100 may be analyzed in conjunction with images of the user or information about the user captured before a shaving session. For example, before shaving takes place, a user may download an application on his or her smartphone or computer, or access an application via the internet. The application may prompt the user to take or upload one or more photographs or videos of the relevant body part to be shaved. The camera device used to capture user images may be the camera built into or connected to a smartphone or computer, or a separate camera, from which the images may be downloaded and then uploaded to the application via a hard or wireless connection.

The photographic information may be stored in a database, and, based on the photographic information, a three-dimensional (3D) model of the user's face may be generated. In some embodiments, particular landmarks and/or digital flag posts may be generated corresponding to anatomical features. In some embodiments, the body region photographed may be broken up into shaving regions. For example, a user may define which areas of the body region are to be shaved, or the application may automatically break the image up into regions that represent the average shaving patterns of people generally or of that particular user. As the user shaves, grip information may be analyzed in conjunction with the images, three-dimensional model, and/or shaving regions in order to provide feedback to the user.

As discussed further below, additional information not detected by sensors 20, for example, the user's hair type, hair thickness, desired level of shave, etc., may also be considered in conjunction with the user image(s) and/or the data from sensors 20 in order to assess the user's shaving behaviors. This information and more may be provided by the user prior to the shaving session, as will be described further below.

Data captured by sensors 20, imaging information uploaded by a user, and/or data input by a user may be stored in a memory and/or analyzed by a processor to determine how the user interacts with shaver 100 (e.g., grip position, force applied, shaving technique used, etc.) and/or the consequences of the user's grip behaviors based on the other information. In some embodiments, data from sensors 20 may be transmitted to a smartphone or computer having a processor equipped with software configured to analyze the received data to determine how a user handles shaver 100. It is acknowledged that the processor and/or memory may be located on any component of the shaving system, for example, shaver 100, a sleeve with sensors that couples to handle 10 of shaver 100, a base associated with shaver 100, a smartphone, or a computer, and that the components of the shaving system may transmit any stored or detected data to the processor for analysis.

Based on the analysis of this data (e.g., the handle-gripping patterns of a user), a type of shaver or type of handle may be recommended to the user. The recommended shaver or handle may be suitable for use with the user's preferred grip position(s), the amount of force the user applies to handle 10, and/or where the user applies more or less force to handle 10. In some aspects, a custom handle or custom handle sleeve may be recommended to the user, or the option to generate or otherwise fabricate a custom handle or sleeve may be offered to the user. In some embodiments, suggestions for improving the user's shaving experience and/or shaving results may be offered to the user.

For example, if a user tends to hold handle 10 by the distal end of the shaver, near razor cartridge 200, then a type of shaver 100 with more blades 109 in razor cartridge 200 may be recommended for the user. If a user tends to hold handle 10 along the sides, then a shaver 100 that requires less pressure to achieve a clean shave may be recommended. In some instances, if the user's index finger is positioned on the upper side of shaver 100, then the user may generally tend to apply more pressure to shaver 100. If, however, the user's index finger is positioned on the side of shaver 100, then the user may generally tend to apply less pressure to shaver 100. Accordingly, the grip positions frequently utilized by the user may impact what types of shavers, razor cartridges, and/or blades may be relatively more suitable for the user to achieve an efficient and enjoyable shave. Pressure feedback and/or feedback about the type and/or speed of the shaving stroke may also impact the recommendations made to the user.

Instead of, or in addition to, recommendations for shaver types and/or shaver handles, the data may also be used to provide recommendations for other shaving accessories, for example, shaving creams or gels, shaving oil, aftershave, moisturizers, lotions, and/or brushes. In some aspects, the time between replacing blades may also be recommended based on the way the user holds and/or uses shaver 100. In some aspects, it may be recommended that a user apply more or less pressure, select a different grip type, or use a certain shaving motion or stroke (e.g., modify stroke direction, speed, length, etc.), based on the analyzed data. Any suitable shaving tips and/or or combinations of tips may be provided to the user.

Determining a suitable shaver 100 and/or other shaving accessories for a user may also take into account information not detected by shaver 100, for example, the type of hair a user has, the user's desired level of shave (e.g., whether the user wants stubble remaining, wants a clean shave, or wants to leave hair remaining in certain areas), and/or the type of shaver 100 the user is currently utilizing. Other information may include the type of cream or gel applied, the user's shaving history, the shape of the user's body, the density of hair on the user's body, the use history of blades 109 (e.g., how sharp or new they are), the type of shaver 100 generally preferred by the user, the user's skin characteristics (e.g., normal, dry, or sensitive), the user's age (which may affect, e.g., the sensitivity of the user's skin or the quality of the hair, or may affect how the user can comfortably hold a handle), or any other suitable information or combination of information. In some aspects, information about the sex of the user, the size of the user or the user's hands, any disabilities or injuries the user may have, the style of the user's nails (e.g., long or short), or other information may be analyzed to determine how it affects the user's grip on handle 10 and/or how it affects feedback and/or recommendations made to the user. Some or all of this information may be input by the user and assessed along with data from sensors 20, as will be described further below.

In some embodiments, if a shaving product or combination of shaving products is recommended for the user, the user may have the option of ordering some or all of the recommended products. In some aspects, the recommendations may be saved in a memory for future viewing, the recommendations may be e-mailed, texted, mailed, or otherwise shared with the user or with an acquaintance of the user (e.g., as a potential gift idea for the user), the products may be automatically added to the shopping cart or wish list of a shopping website, and/or the products may be automatically delivered to the user for the user to either accept or return. In some embodiments, samples of the recommended products and/or similar products may be delivered to the user. If a customized handle or customized shaver is recommended to the user, specifications for the customization may be sent to a company to prepare for manufacturing. In some aspects, the user may begin to see advertisements and/or coupons for the recommended products in the mail, online, or in a shaving application utilized by the user.

In some embodiments, the recommendation(s) may be provided via an application downloaded onto a phone or computer of the user. For example, a user may open the application on a computer or smartphone prior to, during, and/or after the commencement of shaving. As the user shaves, or after the user shaves, information about the shaving session may be generated by sensors 20 and analyzed, and the results of the analysis may be displayed to the user via the application. In some aspects, this information may be analyzed with information originally provided by the user (e.g., hair type, the type of shaver and/or shaving accessories currently used, images of the user). Charts, text, colors, lights, pictures, or other suitable visual aids may provide various shaving feedback to the user, including, e.g., the user's grip on handle 10, how the positioning of the user's hand affects the user's shave, feedback about shaving efficiency and/or behaviors during that session or over numerous sessions, behavioral tips for future shaving sessions, recommendations for products, and/or how recommended products could improve the user's shaving experience and/or results. In some embodiments, the application may provide auditory or tactile feedback instead of, or in addition to, visual feedback.

It is also contemplated that other feedback may be provided to the user. For example, shaving tips, such as how to hold shaver 100, whether to slow down or speed up a shaving stroke, what angle at which to approach the body with shaver 100, how much more or less pressure to apply to shaver 100 with the hand and/or on the body region, or other suitable feedback or suggested shaving techniques may be provided to the user, in addition to how the user grips handle 10. This information may help to optimize the user's shaving experience and to provide the user with a more efficient and/or comfortable shaving experience.

In this way, using shaver 100, handle 10, and/or a sleeve that couples to handle 10, may provide a user with up-to-date feedback regarding how a user can improve his or her shaving experience based on his or her shaver-usage patterns.

Shaver 100 may include a disposable or rechargeable battery to power sensors 20. Alternatively, shaver 100 may be configured for connection to an electrical power source. In some embodiments, shaver 100, handle 10, and/or a sleeve that fits on handle 10 may have an on/off switch, button, or device for a user to engage prior to use. In other embodiments, shaver 100, handle 10, and/or a sleeve that fits on handle 10 may be have auto-on capabilities, e.g., in response to movement or gripping by the user or detachment of shaver 100 from a stand or base.

Figure 3:
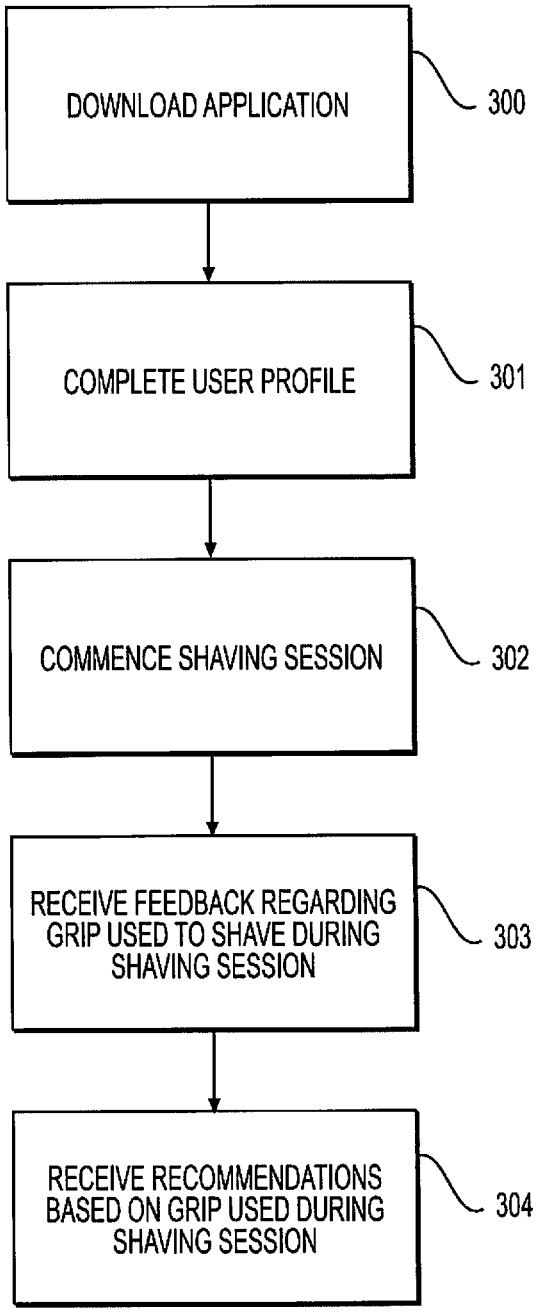
FIG. 3 is a flow chart portraying an exemplary shaving method, according to various embodiments of the present disclosure.

An exemplary shaver 100 may be used in the manner shown in FIG. 3. Those of ordinary skill in the art will recognize that one or more steps of the method depicted in FIG. 3 may be omitted or performed out of the order depicted in FIG. 3. First, a user may download a shaving application to a smartphone or computer, step 300. A user may then complete a user profile, step 301. Completing a user profile may include answering a series of questions or prompts. Exemplary questions in a user profile may include questions regarding the type of hair a user has, the user's desired level of shave (e.g., whether the user wants stubble remaining, wants a clean shave, or wants to leave hair remaining in certain areas), the type of cream or gel typically used, the user's shaving history, the shape of the user's body, the density of hair on the user's body, the use history of the user's blades 109 (e.g., how sharp or new they are), the type of shaver 100 the user is using, the user's skin characteristics (e.g., normal, dry, or sensitive), the user's age (which may affect, e.g., the sensitivity of the user's skin or the quality of the hair or how the user may comfortably hold shaver 100), or any other suitable information or combinations of information. User can also manually input in the system "problematic" regions such as moles, bumps, etc. The user may input information via any suitable means. For example, the user may type information into the shaving application or activate a camera to scan a bar code of the shaver type and/or shaver accessories. In some aspects, the user may upload pictures of himself or herself as part of the profile. The user may be able to go back into the application and modify the answers at a later date, e.g., if the answers to the questions change over time. In exemplary methods, steps 300 and/or step 301 may be omitted if the user has already downloaded the application or has a preexisting shaving profile.

Once the user profile is complete with information and/or images, the user may commence shaving, step 302. As discussed above, during the shaving process, the user may tend to use one or more grips to hold and maneuver handle 10 of shaver 100. While the user is shaving, sensors 20 may detect information about the user's behavior, e.g., the user's grip and the amount of pressure the user applies to handle 10.

After the user is done shaving and/or as the user shaves, at step 303, he or she may receive feedback from shaver 100 and/or the application regarding the grip(s) used during the shaving session, the amount of force applied to handle 10, the speed and/or orientation of shaver 100 during shaving, or any other suitable shaving behaviors. In some aspects, ergonomic benefits or potential ergonomic issues may be identified based on the type of shaver 100 and/or or type of handle 10 the user utilized for the shaving session and/or based on the shaving behaviors exhibited. Feedback may also be provided based on information collected from multiple shaving sessions. For example, feedback may be provided based on changes in the user's grip across shaving sessions, how the user's shaving sessions and/or shaving results have improved over time based on changes in the shaver 100 and/or handle 10 used, the shaving behaviors used, and/or other shaving characteristics or information regarding accessories used over time.

The user may also receive recommendations based on the grip(s) he or she used during the shaving session, step 304. For example, the user may receive recommendations regarding alternative ways of holding handle 10, changes to the speed, location, and/or length of shaving strokes, changes to the amount of pressure applied by the user's hand to handle 10, how frequently to change razor cartridges 200 and/or blades 109, and/or other suitable behavioral changes. The user may also or may alternatively receive recommendations regarding the products used during the shaving session. For example, the user may receive recommendations for different handles 10 or shavers 100 to use during future shaving sessions, or recommendations for customized handles 10 or shavers 100. The user may receive recommendations for different razor cartridges 200, blades 109, or other shaving accessories, e.g., shaving creams or gels, shaving oil, aftershave, moisturizers, lotions, and/or brushes.

Recommendations provided may be unique to the user and/or may be unique to the region being shaved by the user. For example, when shaving a first portion of the user's body, one set of recommendations may be provided, while another set of recommendations may be provided for when the user is shaving a second portion of his or her body. For example, different regions of the user's face may be considered different regions of the user's body, or different body parts (e.g., underarms versus legs) may be considered different regions of the user's body for the purpose of this method.

One of ordinary skill in the art will acknowledge that steps 303 and 304 may be performed in any suitable order and/or may be repeated any suitable number of times. Alternatively, either of steps 303 or 304 may be omitted from the method of FIG. 3; for example, only feedback may be provided or only recommendations may be provided to the user.

Figure 4:
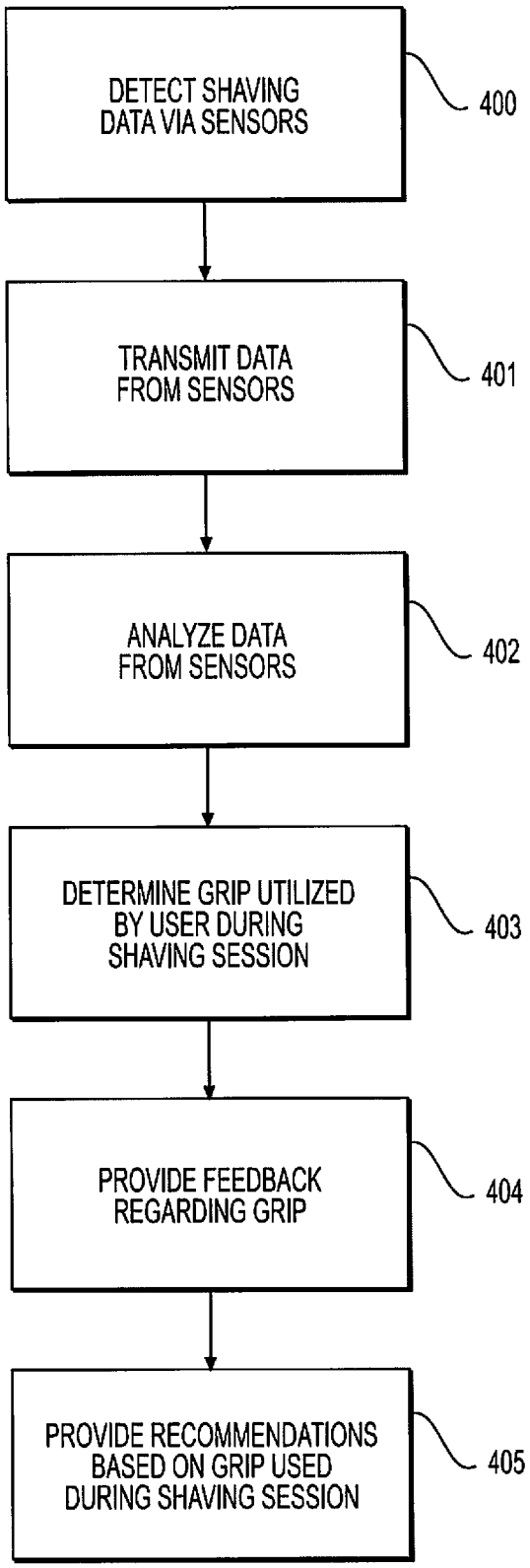
FIG. 4 is a flow chart portraying another exemplary shaving method, according to various embodiments of the present disclosure.

During the shaving process, the shaving system may perform the steps depicted in FIG. 4. As a user begins shaving, sensors 20 on shaver 100 may begin detecting data, step 400. This data may be transmitted from sensors 20 on shaver 100 to a processor for analysis, step 401. The processor may be located on shaver 100, handle 10, a sleeve that fits on handle 10, a smartphone, a computer, or any other suitable component. The processor may have software loaded onto it configured to analyze data from the sensors, step 402. Based on the analysis, the processor may determine the grip utilized by the user during the shaving session, step 403. Depending on the user, more than one grip may be used during a single shaving session. If this is the case, all of the types of grips may be determined, the most common grips(s) may be determined, and/or the type of grip used when exhibiting a certain shaving behavior and/or when shaving a certain region may be determined.

In some embodiments, the processor may also be configured to analyze data stored in a database, which may include, e.g., information from the user profile or other information input by the user (e.g., the user's hair type, the user's body shape, the user's shave preference, and/or previously acquired images of the user's body region).

Feedback regarding the grip and/or grips utilized by the user during the shaving session may then be provided to the user, step 404. Feedback may additionally be provided regarding the amount of force applied to handle 10 when shaving, the speed and/or orientation of shaver 100 when shaving, or any other suitable shaving behaviors. In some aspects, feedback may be provided regarding the ergonomic benefits or potential ergonomic issues based on the type of shaver 100 and/or the type of handle 10 the user utilized for the shaving session and/or based on the shaving behaviors exhibited. Additional information, for example, the speed or length of a shaving stroke, the amount of pressure applied by the user during the shaving session, or other suitable feedback may also be provided.

Feedback may also be provided based on information collected from multiple shaving sessions. For example, feedback may be provided based on changes in the user's grip across shaving sessions, how the user's shaving sessions and/or shaving results have improved over time based on changes in the shaver 100 and/or handle 10 used, the shaving behaviors used, and/or other shaving characteristics or accessories used over time.

Recommendations may alternatively or additionally be provided to the user, step 405. The recommendations provided may be based at least in part on the type of grip(s) utilized by the user during one or more shaving sessions. Recommendations provided may include alternative ways of holding handle 10, changes to the user's speed, location, and/or length of shaving strokes, changes to the amount of pressure the user applies to handle 10, how frequently the user should change razor cartridges 200 and/or blades 109, and/or other suitable behavioral changes. Recommendations may also be provided regarding the products that a user should use in future shaving sessions. For example, the method may include providing recommendations for different handles 10 or shavers 100 for the user to utilize during shaving, or recommendations for customized handles 10 or shavers 100 for the user to utilize to improve shaving enjoyment and/or results. Recommendations for different razor cartridges 200, blades 109, or other shaving accessories, e.g., shaving creams or gels, shaving oil, aftershave, moisturizers, lotions, and/or brushes, may also be provided to the user.

Recommendations provided may be unique to the user and/or may be unique to the region being shaved by the user. For example, different sets of recommendations may be provided when different regions of the user's body are being shaved. For example, different regions of the user's face may be considered different regions of the user's body, or different body parts (e.g., underarms versus legs) may be considered different regions of the user's body for the purpose.

One of ordinary skill in the art will acknowledge that steps 404 and 405 may be performed in any suitable order and/or may be repeated any suitable number of times. Alternatively, either of steps 404 or 405 may be omitted from the method of FIG. 4; for example, only feedback may be provided or only recommendations may be provided.

The many features and advantages of the present disclosure are apparent from the detailed specification, and thus, it is intended by the appended claims to cover all such features and advantages of the present disclosure that fall within the true spirit and scope of the disclosure. Further, since numerous modifications and variations will readily occur to those skilled in the art, it is not desired to limit the present disclosure to the exact construction and operation illustrated and described, and accordingly, all suitable modifications and equivalents may be resorted to, falling within the scope of the present disclosure.

Moreover, those skilled in the art will appreciate that the conception upon which this disclosure is based may readily be used as a basis for designing other structures, methods, and systems for carrying out the several purposes of the present disclosure. Accordingly, the claims are not to be considered as limited by the foregoing description.

What is claimed is:

1. A shaving system comprising:

a shaver handle and one or more sensors, wherein the one or more sensors are configured to detect a hand of a user on the handle and to generate one or more sensor signals;

a processor operably coupled to the one or more sensors and having at least one algorithm stored therein for analyzing the one or more sensor signals to determine ergonomic information relating to a hand of the user on the handle; and an indicator operably coupled to the processor, wherein the indicator is configured to provide at least one of feedback or a recommendation to the user based at least in part on a gripping behavior of the user during a shaving session, the feedback or the recommendation including at least one of a type of handle, a type of shaver, a type of razor cartridge, or a type of blade for the user to use during a subsequent shaving session.

2. The shaving system of claim 1, wherein the one or more sensors includes one or more piezoelectric sensors, pressure sensors, temperature sensors, light sensors, or conductance sensors.

3. The shaving system of claim 1, wherein at least one of the processor or the indicator are located on either a phone or a computer.

4. The shaving system of claim 1, wherein the shaver includes two or more sensors located on the handle.

5. The shaving system of claim 1, wherein the handle includes a removable sleeve.

6. The shaving system of claim 5, wherein the one or more sensors are located on the removable sleeve.

7. The shaving system of claim 1, further comprising a razor cartridge, wherein at least one of the one or more sensors is located on the one cartridge.

8. The shaving system of claim 1, wherein the indicator includes at least one of an auditory, a visual, or a tactile indicator.

9. A method of determining a shaving behavior of a user, the method comprising:

receiving one or more signals indicative of the shaving behavior from one or more sensors located on a shaver;

analyzing the one or more signals to determine a gripping behavior of a hand of the user on a handle of the shaver during a shaving session; and providing at least one of feedback or a recommendation to the user based on the gripping behavior of the hand of the user during the shaving session.

10. The method of claim 9, wherein providing at least one of the feedback or the recommendation includes providing visual feedback on a display.

11. The method of claim 9, wherein analyzing the one or more signals includes assessing the one or more signals in combination with information input by the user.

12. The method of claim 9, further comprising:

generating the one or more signals using the one or more sensors located on the shaver; and transmitting the one or more signals to a processor operably coupled to the one or more sensors and having at least one algorithm stored therein for analyzing the one or more signals.

13. A method of determining a gripping behavior of a user on a handle of a shaver, the method comprising:

analyzing a plurality of signals generated by a plurality of sensors located on a shaver;

determining the gripping behavior of the user based on the plurality of signals;

generating at least one of feedback or a recommendation based on the gripping behavior used by the user; and providing the feedback or the recommendation to the user.

14. The method of claim 13, wherein the analyzing step further comprises analyzing the plurality of signals in combination with information provided by the user.

15. The method of claim 14, wherein the feedback or recommendation includes at least one of a type of handle, a type of shaver, a type of razor cartridge, or a type of blade for the user to use during a subsequent shaving session.

16. The method of claim 15, wherein the feedback includes at least one of shaving efficiency, behaviors during a shaving session, behaviors over a plurality of shaving sessions, behavioral tips for future shaving sessions, or how recommended products could improve the user's shaving experience and/or results.

17. The method of claim 13, and prior to analyzing the plurality of signals, comprising:

generating the plurality of signals using the plurality of sensors located on a shaver; and transmitting the plurality of signals to a processor operably coupled to the plurality of sensors and having at least one algorithm stored therein for analyzing the plurality of signals.

* * * * *